United States Patent [19]

Diederichs, Jr.

[11] Patent Number: 4,592,159

[45] Date of Patent: Jun. 3, 1986

[54] DEVICE FOR SIGNALING

[75] Inventor: Hanns-Juergen Diederichs, Jr., Grande, Fed. Rep. of Germany

[73] Assignee: NICO-PYROTECHNIK Hanns-Juergen Diederichs GmbH & Co. KG, Trittau, Fed. Rep. of Germany

[21] Appl. No.: 572,669

[22] Filed: Jan. 20, 1984

[30] Foreign Application Priority Data

Jan. 20, 1983 [DE] Fed. Rep. of Germany ..... 3301683

[51] Int. Cl.[4] ..... F41C 3/02

[52] U.S. Cl. ..... 42/1 Z

[58] Field of Search ..... 42/1 Z

[56] References Cited

U.S. PATENT DOCUMENTS 3,270,455 9/1966 Smernoff et al. ..... 42/1 Z 4,266,357 5/1981 Greenleaf ..... 42/1 Z

FOREIGN PATENT DOCUMENTS 476631 12/1952 Italy ..... 42/1 Z 399247 3/1966 Switzerland ..... 42/1 Z 1595074 8/1981 United Kingdom ..... 42/1 Z

*Primary Examiner*—Charles T. Jordan

[57] ABSTRACT

A signaling device for firing signaling cartridges in an emergency. The signaling cartridges are adapted to emit light, noise and or smoke signals. The device includes a grip which is manually grasped and which includes a firing lever adapted to be pressed inwardly. The firing lever when in a normal inoperative position forms part of the grip contour. When the firing lever is pressed inwardly it lifts off a rotatably mounted hammer from a firing pin. The hammer then snaps back via the force exerted by a spring to actuate the firing pin. Simultaneously with actuation of the hammer the firing lever also effects a rotational advance of a cartridge magazine of the signaling device. Alternately, the cartridge magazine can be rotationally advanced with the thumb of the user of the device. When the signaling device is held in its "natural" position it is vertically upwardly oriented so that signaling cartridges are fired in that direction.

11 Claims, 16 Drawing Figures

DEVICE FOR SIGNALING

BACKGROUND OF THE INVENTION

The invention relates to a signaling device which fires signaling cartridges from a firearm.

Signaling devices of this type can employ light, smoke and/or sound signals all of which are suitable to signal emergencies for the purpose of alerting third parties to undertake rescue operations.

Signaling devices of this type are therefore used in oceanic voyages, during air travel and during military operations.

The signaling devices of the state of the art are constructed preponderately in the form of hand firearms, so that their outward appearance, i.e. their total mass, inhibits their use in recreational applications, for example, during pleasure boat trips or other types of water sport activities, in particular also surf boarding or mountain climbing.

The constructional format of the aforedescribed state of the art signaling devices are based essentially on firearms manufacturing techniques. A natural manipulation of such a signaling device presupposes a horizontal firing direction. For purposes of obtaining a high angle of fire for making the emergency signal recognizable from as far a distance as possible, the muzzle of the signaling piston must first be turned into a vertical direction before firing. This requires an unnatural manipulation, which in an emergency situation is burdensome on the person which requires emergency assistance. Attempts have been made to construct signaling devices which depart from the conventional weapon construction format insofar as their outward appearance is concerned and which by means of a natural manipulation are capable of emitting an emergency signal in a vertical direction. In the state of the art signaling devices of this type require two-handed operation of the signaling device, whereby one hand of the operating person is necessary for the gripping action and the other hand for the firing step. Obviously such an operation and construction does not meet the aforedescribed requirements of an emergency signaling device, in particular when taking into consideration that in many emergency situations the person requiring assistance may be wounded or otherwise incapacitated, and may have lost the use of both hands, or at best, have only the use of one hand.

SUMMARY OF THE INVENTION

It is an object of this invention to provide a signaling device for firing signal cartridges, which requires only the use of one hand for operating the device. The device of the invention can be fired in a vertical direction for emitting an emergency signal by means of natural manipulation and the use of only one hand. Moreover, the signaling device of this invention is of simple and rugged construction, so that as a result of its low manufacturing cost it can also be used in pleasure and recreational activities.

BRIEF DESCRIPTION OF THE DRAWING

With these and other objects in view, which will become apparent in the following detailed description, the present invention, which is shown by example only, will be clearly understood in connection with the accompanying drawing, in which.

DETAILED DESCRIPTION

The signaling device of this invention is designed for an easy natural manipulation with one hand by a person operating it under emergency conditions, whereby the emission of the distress signal, that is the firing of a tracer, respectively smoke charge, can, under certain circumstances, also be combined with the emission of a sound signal. Such firing is generally directed in an upward vertical direction.

Figure 1:
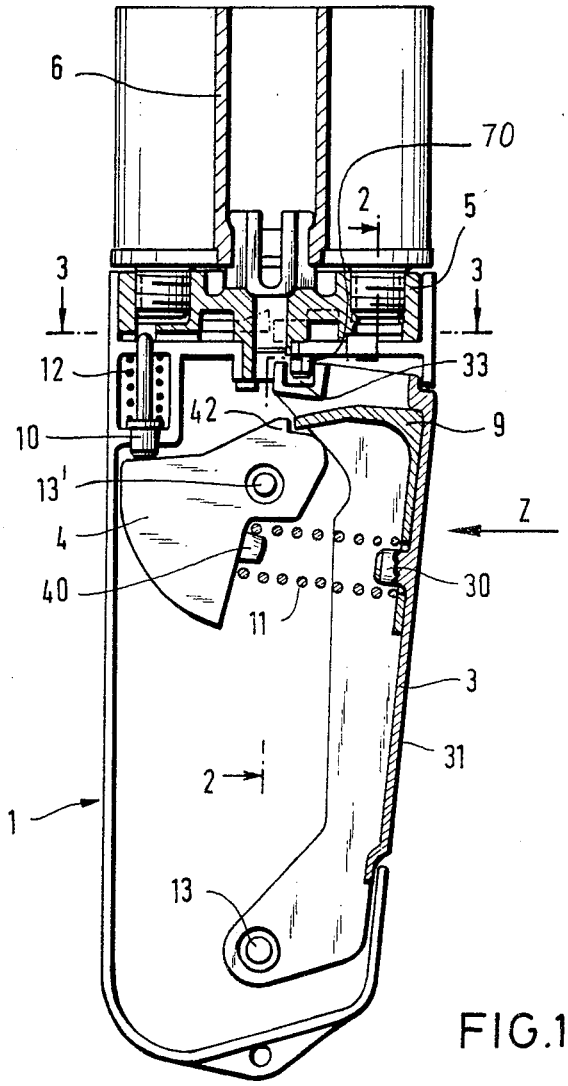
FIG. 1 is a partially cross-sectional side elevational view of the signaling device with the hand grip on which a cartridge magazine is mounted.

The signaling device in accordance with FIG. 1 includes a grip 1 which is constructed so as a to include a firing mechanism and also has means for rotatably advancing the hollow body which forms the magazine 6. The longitudinal axis of the magazine 6 is oriented vertically when the device is held manually in a natural position. The detailed construction of the magazine 6 will be described hereinafter. The magazine 6 is mounted on top of the grip 1 and is connected to it in such a way that the firing direction coincides with the direction of the longitudinal axis of the grip. The grip 1 is dimensioned in such a way that it can be comfortably manually handled. The grip 1 includes two grip halves 1', 1'' which are connected to each other by means of countersunk threaded screws 13, 13'. The two halves 1', 1'' define, when joined to each other, an essentially parallelepiped space therebetween. Since the grip halves 1', 1'' are preferably made out of synthetic material, there is inserted in at least one of the two grip halves 1', 1'' a threaded insert made out of metal or some other particularly high quality synthetic material for purposes of insuring a safe and reliable threaded connection between the two halves. One of the two opposite narrow wall portions of the grip 1 is at least partially formed by an actuating surface 31 of a firing lever 3. When such lever is in an inoperative position the actuating surface 31 forms a continuation of the outer surface of the grip 1. The actuating surface 31 is comparatively large and in view of its size can be clampingly gripped in a normal actuating position even with clammy fingers or with a glove-covered hand, so that the signaling device can be reliably actuated even in an emergency situation. In view of the fact that both grip halves 1', 1'' are held together by means of countersunk threaded screws 13, 13', the axes for the hammer 4 and firing lever 3 are parallelly disposed. The hammer 4 is in operative contact with an inwardly extending claw 9 of the firing lever 3, on the one hand, and with the firing pin 10 for firing the signaling cartridge, on the other hand. There is disposed between the hammer 4 and the firing lever 3 a coil spring 11 which is mounted on two pins 40 and 30 and which bias the firing lever 3 outwardly into an inoperative position. The firing movement is exercised against the pressure exerted by the coil spring 11.

Figure 9:
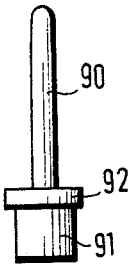
FIG. 9 is a side elevational view at an enlarged scale of the firing pin.

The firing pin 10 (FIG. 1, FIG. 9) consists essentially of two cylindrical portions 90, 91 of differing diameters, both of which adjoin a collar 92 disposed therebetween. The cylindrical body 90 has a rounded off upper end which coacts with the ignition cap of the to-be-fired signal cartridge, whereas the end face of the shorter lower cylindrical body 91 acts as an impact receiving surface for the hammer 4. The cylindrical peripheral surfaces of the cylindrical bodies 90, 91 of the firing pin 10 serve for slidingly mounting the firing pin in mating bores of the grip 1. A coil spring 12 which is coaxially arranged with respect to the firing pin 10 biases the firing pin 10 into an inoperative position, in which the collar 92 of the firing pin 10 abuts against the inner wall of the grip 1.

Firing Operation

The firing process is carried out as follows: The fingers of the hand which grasp the grip 1 pivot the firing lever inwardly about the axis of screw 13 towards the longitudinal axis of the signaling device, whereby the coil spring 11 mounted on the opposite pins 30 and 40 is compressed. The inner end of the claw 9, which is fixedly connected to the firing lever 3, abuts against a step 42 on the outer peripheral surface of the hammer 4 and imparts a pivotal movement to the hammer 4 about the axis of screw 13' in a counterclockwise direction as viewed in FIG. 1. Thereby contact between the hammer 4 and firing pin 10 is interrupted, which contact is established by the actions of the coil springs 11 and 12. As the firing lever is pressed further inwardly, the coil spring 11 is further compressed and simultaneously therewith the free end of the claw 9 slips past the step 42 and finally releases the hammer 4, which now under the action of the strongly compressed coil spring 11 snaps back in a clockwise direction onto the lower impact surface of the firing pin 10. The firing pin 10 is then lifted off its inoperative position and moves, counter to the force of the coil spring 12, parallel to the longitudinal axis of the signaling device in the direction towards the ignition cap of an aligned signaling cartridge. After unloading of the firing lever 3 by releasing the finger pressure thereon, the firing pin 10, hammer 4 and firing lever 3 return to the respective inoperative position as illustrated in FIG. 1. In such position, the firing lever 3 rests against the inner wall of the grip 1 which constitutes a stop for it.

Figure 15:
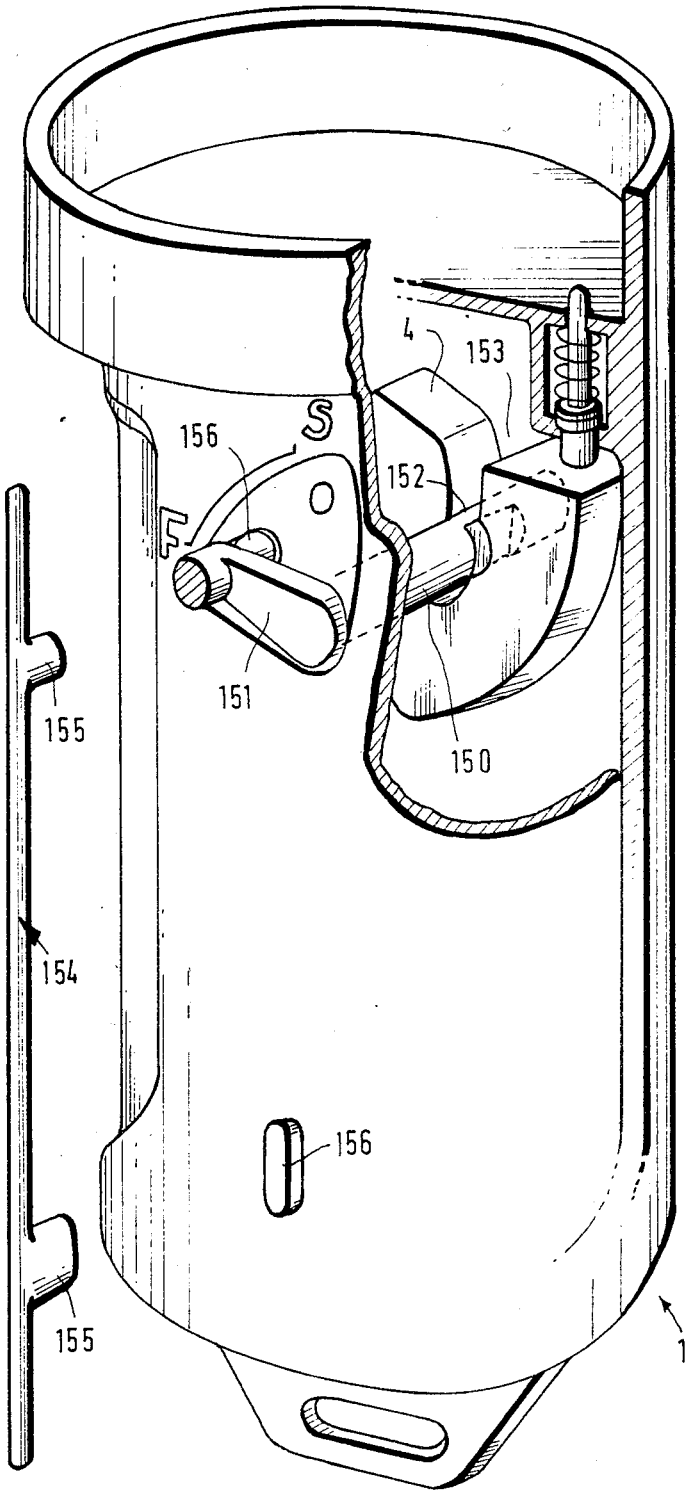
FIG. 15 is a perspective explosive view in side elevation of the grip of the signaling device of this invention in which portions have been cut away to also illustrate the safety.

A suitable safety mechanism for this device is described in conjunction with FIG. 15 which illustrates in perspective a side elevational view of the grip 1. The safety mechanism prevents, when in its operative safety position, an impacting of the hammer 4 onto the firing pin 10. This safety mechanism includes a shaft 150 which is rotatably mounted in two opposite openings respectively disposed in opposite halves 1', 1'' of the grip 1. The shaft 150 has an integral crank lever 151 adapted to rotate the shaft 150 over a predetermined angular range. Thus it can be observed from FIG. 15 that the crank lever 151 is adapted to rotate over a predetermined angular range determined by an indentation in the grip between a lockable safety position S, on the one hand, and a firing position F, on the other hand. The actuation of the safety lever 151 is effected by means of the thumb of the hand grasping the grip 1. The safety lever 151 includes a flat portion which is adapted to pivotally move over a flattened arcuate indentation on the outer periphery of the grip 1 so that the region 152 of the shaft 150 is defined by two opposite parallel flat surfaces, on the one hand, and two opposite cylindrical peripheral surfaces, on the other hand. The region 152 of the shaft 150 extends through a slit 153 in the hammer 4 (see FIG. 15) the width of which is less than the maximum diameter of the shaft 150 in its region 152. When in the safety position S, the flat limit surfaces of the region 152 of the shaft 150 when holding the grip 1 in a vertical position are disposed in horizontal planes, so that the slit 153 of the hammer 4 "sees" the largest diameter of the shaft 150 in its region 152. As a result of this, the hammer 4 cannot carry out the necessary rotational movement for releasing the firing pin 10, in view of the fact that the slit 153 cannot pass past the shaft 150. When the safety lever 151 is in the firing position F and the grip 1 is held in a vertical position, the parallel flat limit surfaces of the region 152 of the safety shaft 150 are disposed in vertical planes so that the slit 153 "sees" only the relatively reduced cross-sectional dimension of the flattened region of the safety shaft 150. The hammer 4 can now freely rotate about its rotational axis and impact on the firing pin 10 since it is no longer blocked by the safety shaft portion 152 of the shaft 150. There is illustrated schematically in FIG. 15 a holding bar 154 which includes two laterally projectiong nose portions 155 which engage into mating recesses, respectively openings 156 of the grip 1. This engagement is only possible when the safety lever 151 is disposed in the safety position S. In this manner an unintentional firing is eliminated when the holding bar 154 engages in the recesses 156, despite the fact that the signaling device is in a loaded and ready condition.

Figure 5:
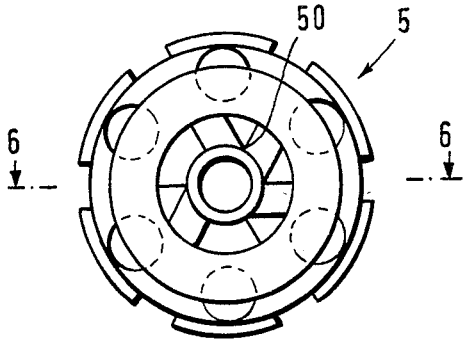
FIG. 5 is a top plan view of the top surface of the transport disc which surface is facing away from the magazine.
Figure 6:
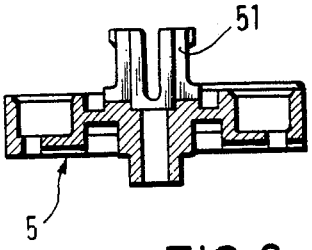
FIG. 6 is a cross-sectional view through the transport disc along line 6—6 of FIG. 5.
Figure 7:
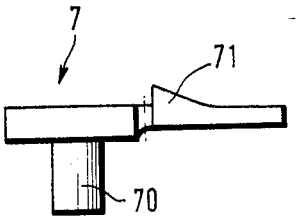
FIG. 7 is a side elevational view of the follower.
Figure 8:
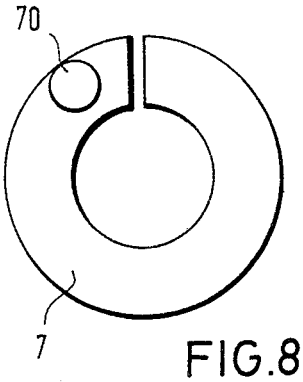
FIG. 8 is a top plan view of the follower.

The firing lever 3 serves not only to introduce the firing process, but also serves the double function of advancing the rotatably arranged magazine 6 in which the signal cartridges are mounted. In order to effect this advancement, the linear movement of the free end of the firing lever 3, which is disposed in a plane that also includes the longitudinal axis of the signaling device, must be transformed into a rotational stepwise movement. For this purpose the free end piece of the firing lever 3 includes a pot-like recess 33 (FIG. 1) in which a pin 70 engages. The pin 70 projects downwardly from the plane of an entrainment ring 7 (see FIGS. 7 and 8). In view of the fact that the pin 70 is eccentrically arranged the force, which is tangentially applied by the movement of the firing lever 3 during the pressing in and releasing of the firing lever 3, leads to a rotational movement of the entrainment ring 7 with a maximum predetermined angular rotation which encompasses only a predetermined circular segment. The entrainment ring 7 is illustrated at an enlarged scale in FIGS. 7 and 8. FIG. 7 illustrates a side elevational view and FIG. 8 a plan view illustrating the exterior periphery of the entrainment ring 7 from which the pin 70 projects. The outer surface of the entrainment ring 7 which faces away from the pin 70 includes a step 71 which engages one of the roof-like inclined projections 50 of the transport wheel 5 (FIG. 5). FIG. 6 illustrates in cross-section the transport wheel 5 along line 6—6 of FIG. 5. On the exterior surface of the transport wheel 5 which faces away from the grip 1 (FIG. 6) there is arranged an upwardly projecting slitted post-like projection 51 on which the magazine carrying the signal cartridges can be mounted. This connection between the slitted post-like projection 51 and the signal cartridge magazine 6 is a detachable but reliable connection in view of the outwardly directed biasing force exerted by the slitted post-like projection 51 against the central bore of the magazine 6. The further advance of the signal cartridges is effected as follows: A starting condition is assumed in which an ignitable signal cartridge is disposed above the firing pin 10. This condition corresponds to the ready condition of the signaling device. The pressing in of the firing lever 3 leads to the aforedescribed firing operation. Simultaneously with the pivotal movement of the unilaterally pivotally supported firing lever 3 there is however also effected a rotational movement of the entrainment ring 7, in view of the fact that the pin 70 of the entrainment ring 7 engages into the post-like recess 33 disposed at the free end of the firing lever 3. With this rotational movement the edge of the step 71 of the entrainment ring 7 slides along the roof-like inclined oblique surface of one of the projections 50 of the transport wheel 5, whereby the latter remains at a standstill and does not participate in the rotational movement of the entrainment ring 7. This step 71 finally meshingly catches, after overcoming the forces exerted by the inclined surface behind a projection 50, and rotates then when the firing lever 3 is released into its inoperative position the transport wheel 5 about the predetermined angular value, so that a new ignitable signaling cartridge is now disposed over the firing pin 10 and the ready firing condition of the signaling device is again attained.

In order to simplify and reduce the manufacturing cost of the signaling device an ejection mechanism for the fired signaling cartridge was deliberately omitted. The fired spent signaling cartridges can be manually removed without difficulty from the magazine and replaced with new cartridges.

Figure 10:
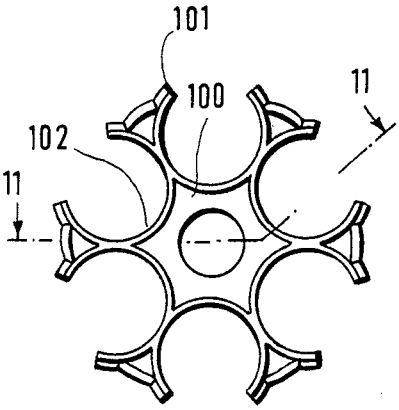
FIG. 10 is a plan view of the end outer surface of the magazine.
Figure 11:
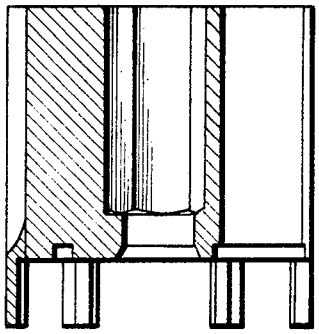
FIG. 11 is a cross-sectional view through the magazine along line 11—11 of FIG. 10.
Figure 12:
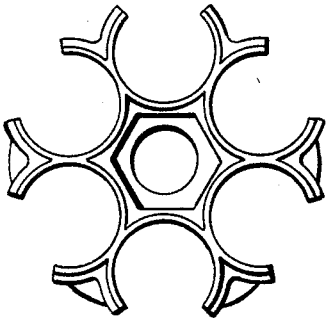
FIG. 12 is a plan view of the exterior end face of the magazine which confronts the grip of the device.

The simple construction of the plugable magazine can be clearly noted from FIGS. 10, 11 and 12. FIGS. 10 and 12 illustrate plan views of the end faces of the magazine, whereas FIG. 11 illustrates a longitudinal sectional view of the magazine along line 11—11 of FIG. 10. As can be noted the end faces are star-shaped, in view of the fact that they have radial extension which project outwardly from a central column, between which extensions the signaling cartridges are clampingly held.

Figure 2:
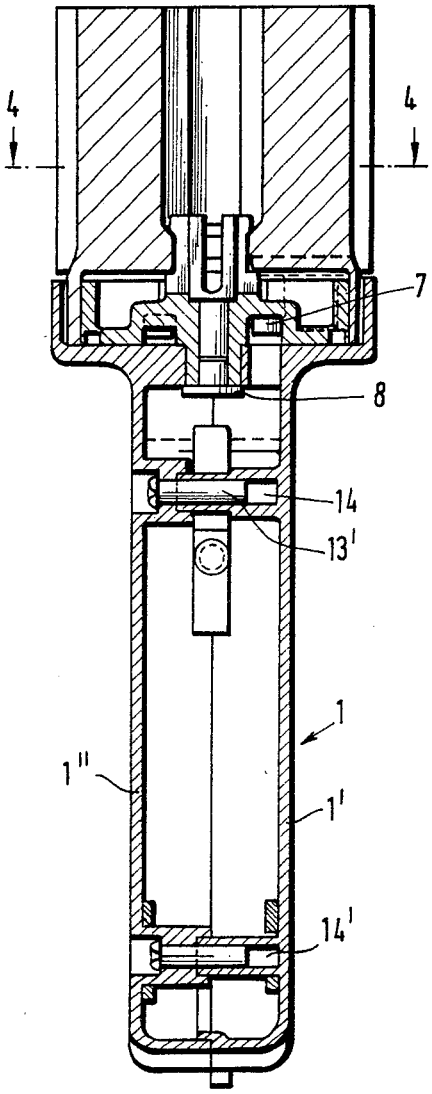
FIG. 2 is an end side elevational partially cross-sectional view illustrating the narrow side of the hand grip in the direction of the arrow Z in FIG. 1 and along the plane 2—2 of FIG. 1.
Figure 3:
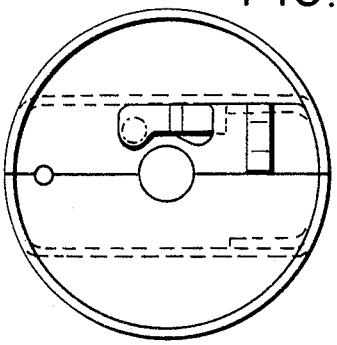
FIG. 3 is a cross-sectional view along line 3—3 of FIG. 1.
Figure 4:
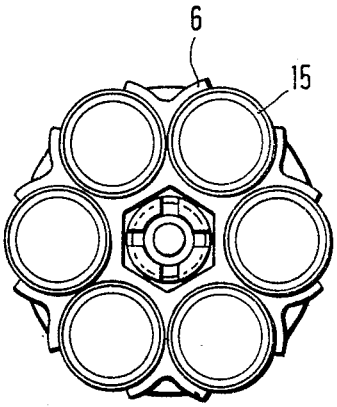
FIG. 4 is a cross-sectional view through the magazine of the signaling device along line 4—4 in FIG. 2.

FIG. 4 illustrates in cross-section a magazine filled with signaling cartridges along line 4—4 in FIG. 2 by means of which the loaded condition of the magazine is clearly illustrated. The aforedescribed constructional features of the cartridge magazine are particularly advantageous in view of their weight-saving characteristics.

The signaling device armed with the plugged-on magazine can be carried in a ready position by means of suitable suspension means which have not been described in detail herein so as to be fixed on a support, but nevertheless be at all times ready to be manually gripped. Various mounting possibilities must be considered in particular in conjunction with motor vehicles of all types, in which there must be provided sufficient space for mounting the signaling device.

Figure 13:
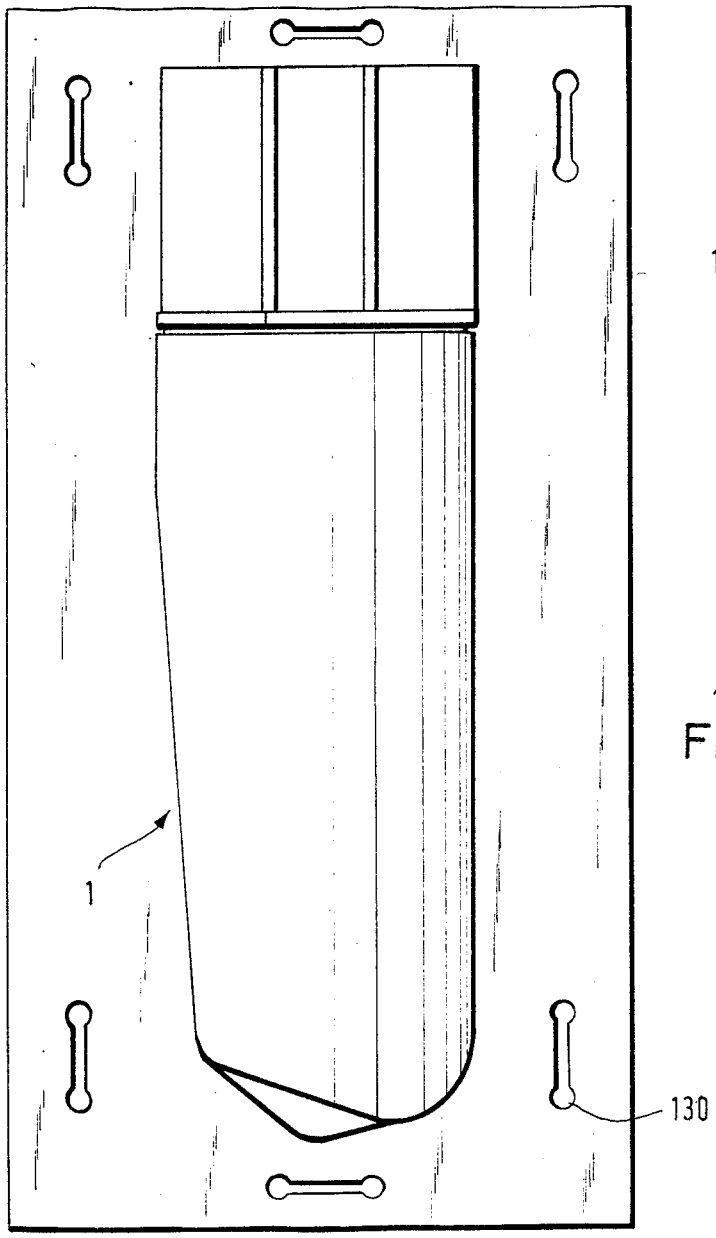
FIG. 13 is a plan view of the signaling device of this invention as packed in a plastic blister package.
Figure 14:
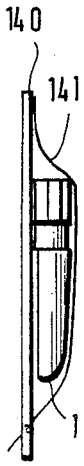
FIG. 14 is a side elevational view of the package of FIG. 13 shown at a reduced scale.

The signaling device can, however, be advantageously used in conjunction with sports, respectively recreational uses, when a fixed mounting cannot be considered and the signaling device must be carried by the person who may have need to use it. In this connection the mountain climbing and surfing activities are of particular interest. In case of such application, the signaling device, having the plugged-on magazine and being in a ready condition, must be provided with a suitable belt so that it can be mounted on a backpack, clothing or directly on a limb of the person contemplating using it. Such a mounting of the signaling device in a particular advantageous manner is illustrated in conjunction with FIGS. 13 and 14, in which a particularly favorable storage presentation of the signaling device is illustrated. The packaging format is that of a blister package, respectively a shrink-foil packaging in a packaging region, which is a conventional well-known method of packaging. It consists of a support surface 140 made out of cardboard, synthetic material or the like. On this support surface 140 the signaling device is mounted and covered by a transparent synthetic foil 141. Openings or recesses are provided in the support surface 140, through which a belt can be pulled for transporting or supporting the signaling device.

Figure 16:
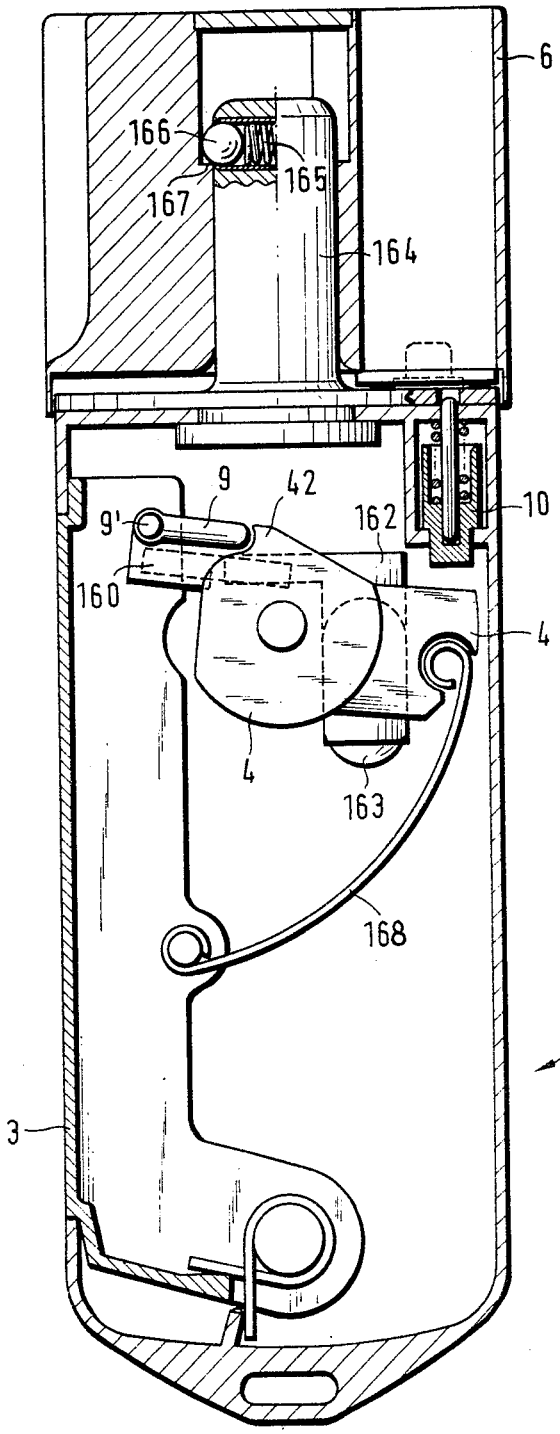
FIG. 16 is a side elevational cross-sectional view of a second embodiment of the device of this invention.

FIG. 16 illustrates in longitudinal section a further embodiment of the invention, which distinguishes itself by means of a particular advantageous safety arrangement. This safety arrangement prevents an actuation of the signaling device and thereby the firing of a signaling cartridge when the muzzle of the magazine is directed towards the person using the signaling device. This is attained in a simple manner in that the claw 9 is pivotally mounted on the free end of the firing lever 3 about an axis 9' and additionally has a dead weight 160 made out of metal, for example iron. When the signaling device is correctly oriented, that is with the muzzle oriented upwardly, the rotatable claw 9 abuts against the hammer 4 and engages in the step 42 of the hammer 4. When pressing the firing lever inwardly the hammer 4 is rotated and the firing process, as has been described hereinabove, is initiated. However, when the signaling device is inclined, in particular when the muzzle opening of the magazine is directed towards the person servicing it, the claw 9 tilts, as a result of the gravitational force of the dead weight rod 160 in such a way about the axis 9' that the claw 9 is lifted off the hammer 4 and no longer engages into the step 42. Pressure exerted on the firing lever 3 therefore no longer causes a rotational movement of the hammer 4 and can therefore no longer initiate a firing operation.

The claw 9, which is rotatably movably arranged, simplifies also the arrangement for the safety mechanism of the signaling device 1. In this embodiment a slidable safety switch 163 is provided, which is arranged parallel to the longitudinal axis of the signaling device and is adapted to assume two positions, that is a safety position "S" and a firing position "F" between which it is slidably movable. The safety switch 163 supports a stop 162 which extends in a radial direction. When the safety switch 163 is in the safety position "S" the claw 9 is lifted off the step 42 of the hammer 4 and thereby, at actuation of the firing lever 3, cannot effect a rotation of the hammer. When in the firing position "F" the safety switch 163 is slid downwardly out of the path of the claw 9 so that the projection 162 is no longer in contact with the claw 9. The claw 9 can then again engage the hammer 4 behind the step 42 and when the firing lever is pressed in rotate the hammer for releasing the firing process.

In contradistinction to the previously described embodiment of the invention the construction of the signaling device of FIG. 16 is even further simplified in view of the fact that all movable parts for the automatic rotation of the magazine 6 have been omitted. In this embodiment there is merely provided in the head of the signaling device 1 a centrally arranged fixed magazine holder 164. This magazine holder 164 includes a lateral bore in which at least one ball 166, outwardly biased by a coil spring 165, is disposed which exerts a force in a radially outward direction on the inner walls of a magazine 6 which is mounted thereon. A new cartridge 15 of the magazine 6 is moved into a firing position in a simple way in that the magazine 6 is manually moved into a firing position by means of the thumb of the hand holding the magazine 6 of the signaling device, whereby the natural holding and retention force of the coil spring 165 must be overcome. For purposes of obtaining a simple and secure rotational movement of the magazine 6 the ball 166 acts on the interior bore wall of the magazine 6, mounted on the magazine holder 164, which bore walls are preferably of hexagonal shape. Since the magazine 6 includes six signaling cartridges, it can be manually advanced by movement of the thumb about an angle of 60° to reach the next detent point, which manual rotation is easily effected. As can be noted from FIG. 16 the ball 166 also securely holds the magazine 6 on the magazine holder 164 in that the ball 166 engages in a step 167 disposed in the ineer wall surface of the bore of the magazine 6.

In contradistinction to the previously described embodiments, the signaling device of FIG. 16 has a hammer which is acted on by a leaf spring 168 rather than a coil spring which leaf spring is connected at one end to the grip 1 and at the other end to the firing lever 3 so as to bias the firing lever outwardly.

Although a limited number of embodiments of the invention have been illustrated in the accompanying drawings and described in the foregoing specification, it is to be expressly understood that various changes, such as in the relative dimensions of the parts, material used, and the like, as well as the suggested manner of use of the apparatus of the invention, may be made therein without departing from the spirit and scope of the invention, as will now be apparent to those skilled in the art.

I claim:

1. An improved signaling device for firing a cartridge having a grip and a cartridge magazine rotatably mounted on the grip, the improvement comprising (a) a grip portion having triggering means which include a firing lever and an actuating surface, whereby when said grip portion is naturally manually held the longitudinal axis of the magazine is oriented substantially vertically;

(b) said cartridge magazine is detachably mounted on said grip portion and the firing direction thereof is oriented vertically upwardly so as to be parallel to the vertical longitudinal axis of the magazine, and (c) a hammer having a stepped surface which is rotatably mounted in said grip portion, a firing pin slidably mounted in said grip portion, first biasing means urging said firing pin into engagement with said hammer, said firing lever including an inwardly projecting claw which opertively engage the stepped surface of the hammer in such a way that upon pressing the claw inwardly via the actuating surface the hammer is rotated so as to be initially lifted off an engagement with said firing pin until said claw slides past said stepped surface.

2. The improved signaling device as set forth in claim 1, wherein said actuating surface is adapted to receive hand pressure and said grip portion defines a hollow body having a pair of opposite wide walls and a pair of opposite narrow walls, said actuating surface when in an inoperative position forming substantially an entire one of said pair of narrow walls.

3. The improved signaling device as set forth in claim 2, wherein said firing lever is pivotally mounted in said grip portion about an axis which is normal to the longitudinal axis of the signaling device, the firing of the signaling device being effected by manually pressing said firing lever inwardly into the grip portion towards the longitudinal axis thereof.

4. The improved signaling device as set forth in claim 1, wherein said hammer is rotatably mounted in said grip portion about a first axis and said firing lever is pivotally mounted in said grip portion about a second axis which is parallel to said first axis, second biasing means being operatively mounted between said firing lever and said hammer, an entraining ring rotatably coaxially mounted on said grip portion in a plane which is about normal to the longitudinal axis of the signaling device, said entraining ring having a downwardly extending projection and said claw having a recess for receiving said projection, whereby when said firing lever is manually released said second biasing means urges it outwardly and causes a rotation of said entraining ring about a predetermined angle via the engagement of said projection in said recess.

5. The improved signaling device as set forth in claim 4, wherein said entraining ring has an upwardly projecting stepped surface which is opposite to the surface having said downwardly extending projection, a transport disc having a plurality of equidistantly circumferentially arranged indentations each one of which is adapted to be matingly engaged by said upwardly projecting stepped surface, and also having a central axially upwardly extending slitted post for receiving said cartridge magazine.

6. The improved signaling device as set forth in claim 5, wherein said post of said cartridge magazine has a plurality of radially outwardly extending legs, each pair of adjoining legs defining a partial cylindrical cartridge holding space therebetween in which a cartridge is clampingly held by the pair of adjoining legs.

7. The improved signaling device as set forth in claim 6, including a safety shaft rotatably mounted in a pair of opposite openings in said grip portion, said safety shaft being cylindrically shaped but having a safety portion whose exterior surface is formed by a pair of flat surfaces spaced at a first distance from each other and a pair of cylindrical surfaces of predetermined diameter, said hammer having a slit the width of which is less than the diameter of the pair of cylindrical surfaces, but is greater than said first distance so that when said pair of flat surfaces are substantially aligned with the walls of the slit the safety portion can pass therethrough, a crank secured to one end of said safety shaft for being rotated with the thumb of the person utilizing the signaling device between a safety position and a firing position along a flat identation on said grip portion.

8. The improved signaling device as set forth in claim 7, including a safety bar having a pair of nose portions projecting therefrom, said grip portion having a pair of outer openings for receiving said pair of nose portions, whereby when said crank is in the safety position and said pair of nose portions are disposed in the pair of outer openings said safety bar prevents said crank from being pivoted into the firing position.

9. The improved signaling device as set forth in claim 4, wherein said inwardly extending claw is pivotally mounted on said firing lever about a third axis and includes a dead weight for biasing said claw about said third axis and out of engagement with said hammer when said signaling device is oriented improperly.

10. The improved signaling device as set forth in claim 9, including switching means slidably mounted on said grip portion to move between a safety position and a firing position, said switching means including step means which are adapted to pivot said claw when said switching means are in the safety position so that it can no longer engage the hammer when said firing lever is pressed inwardly.

11. The improved signaling device as set forth in claim 10, including a centrally upwardly extending post having a radial bore in which a ball is mounted, a coil spring outwardly biasing said ball, said cartridge magazine being detachably mounted on said post and operatively held thereon by said spring-biased ball.

* * * * *